US005167416A

United States Patent [19]

Painter

[11] Patent Number: 5,167,416

[45] Date of Patent: Dec. 1, 1992

[54] GOLF CLUB WITH PERCEPTOR DEVICE

[76] Inventor: Jack L. Painter, 2 Conifer La., Ho-Ho-Kus, N.J. 07423

[21] Appl. No.: 490,381

[22] Filed: Mar. 8, 1990

[51] Int. Cl.[5] ..... A63B 69/36

[52] U.S. Cl. ..... 273/187.6; 273/81 R; 273/81 D; 273/73 J

[58] Field of Search ..... 273/183 E, 81 R, 81 B, 273/81 D, 165, 166, 81.4, 186 A, 183 D, 194 R, 193 B

[56] References Cited

U.S. PATENT DOCUMENTS 1,648,354 11/1927 Lied ..... 273/81.4
4,042,238 8/1977 Theriault ..... 273/73 J
4,128,240 12/1978 Berokoff ..... 273/75

FOREIGN PATENT DOCUMENTS 2750217 5/1979 Fed. Rep. of Germany ..... 273/75

*Primary Examiner*—Theatrice Brown
*Attorney, Agent, or Firm*—John D. Kaufmann

[57] ABSTRACT

The invention is an improvement in a golf club wherein the golf club shaft is provided with a generally planar member located between the handle and the golf club head. The planar member is located near the handle hand grip end and has a finger alignment opening therethrough. The longitudinal axis of the shaft passes through the opening such that a golfer when gripping the handle can extend his index finger through the opening in perpendicular alignment with the longitudinal axis of the shaft for pointing in the direction in which a ball is intended to be hit. The shape of the opening can vary, such as triangular, square, circular, or other desired shapes.

14 Claims, 1 Drawing Sheet

GOLF CLUB WITH PERCEPTOR DEVICE

FIELD OF THE INVENTION

This invention relates to golf clubs and specifically, but not by way of limitation, to golf putters which are improved and configured to utilize a golfer's sense of touch and the concept of finger pointing, as opposed to the sense of sight alone, in putting.

DISCUSSION OF THE PRIOR ART

Heretofore, golf club putters have included a shaft, a striking head and a handle, each of which have, to some degree, been designed to assist eye and hand coordination. There are rigid shafts to reduce vibrations and upright and angled shafts to adjust the golf swing. Putter heads may be flanged and may embody a multitude of other shapes, designs, weights, and sizes in order to assist one in acquiring consistent and accurate putting. Putters have included a wide variety of handles for comfort and sure grip. These handles provide grip configurations, which, some claim, correct push putts to the right or pull putts to the left. The numerous handle, shaft and head designs are a disadvantage to today's golfer because they interfere with the golfer's coordination and may lead to inaccurate putting.

Attempts to solve a variety of golfing problems have been shown in the following patents:

Murphy U.S. Pat. No. 2,873,970
Hartmeister U.S. Pat. No. 3,245,686
Fanning U.S. Pat. No. 3,263,998
Harrison U.S. Pat. No. 3,829,102
Martin U.S. Pat. No. 4,376,536
Axton U.S. Pat. No. 2,583,198

The patents to Murphy, Hartmeister, Fanning and Martin all deal with handle or grip structures. These structures are intended to, for example, relatively position the hands in a predetermined manner; longitudinally align the club shaft, wrist and forearm; remove the club's weight from the fingers exerting the majority of gripping force on the handle; and provide a non-slip, non-tiring, rigid grip surface.

Harrison shows a training device comprising a vaned directing member mounted to the top of the club head. The position of the member relative to the club face is changeable by a remote controller on the handle of the club. A golfer "sights" on a hole by viewing the directing member.

Berokoff, U.S. Pat. No. 4,128,240, shows a tennis racket having a hole in its handle at or near the grip. A user inserts an index finger into the hole while grasping the grip, which purportedly positions the racket at a good hitting angle, despite the necessary unnatural arm position, to put spin on the ball.

None of the above patents solve, or are intended to solve, golf putting problems related to perception.

OBJECTS

One object of the present invention is to provide a golf club putter with a perceptor device which is particularly designed and constructed to overcome certain putting disadvantages associated with existing golf club putters, such as aim at, alignment with and perception of the golf hole. It is another object of the present invention to utilize the concept of finger pointing to improve putting.

By using the present invention, a golfer can overcome certain problem inherent in putting, including those related to aim, alignment, perception and poor eyesight. The sense of touch by the act of finger pointing is used in conjunction with the perceptor device. Golfers frequently say that they have lost their "touch," despite the fact that the involved sense is eyesight, not touch. The present invention eliminates this problem. The golf putter is provided with a perceptor device that provides an opening extending transversely of and intersecting the central longitudinal axis of the shaft of the putter. Accordingly, when one centers the finger in the opening and/or inserts a finger through the opening, appropriate directing or pointing of the finger enables the crucial center strike-point to the golf hole to be lined up with the hole and the head face to be normal to the direction of ball travel. Putters according to this invention are simple, proficient in operation, economical and durable in construction. Further objects and advantages of my invention will become apparent from a consideration of the drawings and ensuing description thereof.

DESCRIPTION OF THE INVENTION

Figure 1:
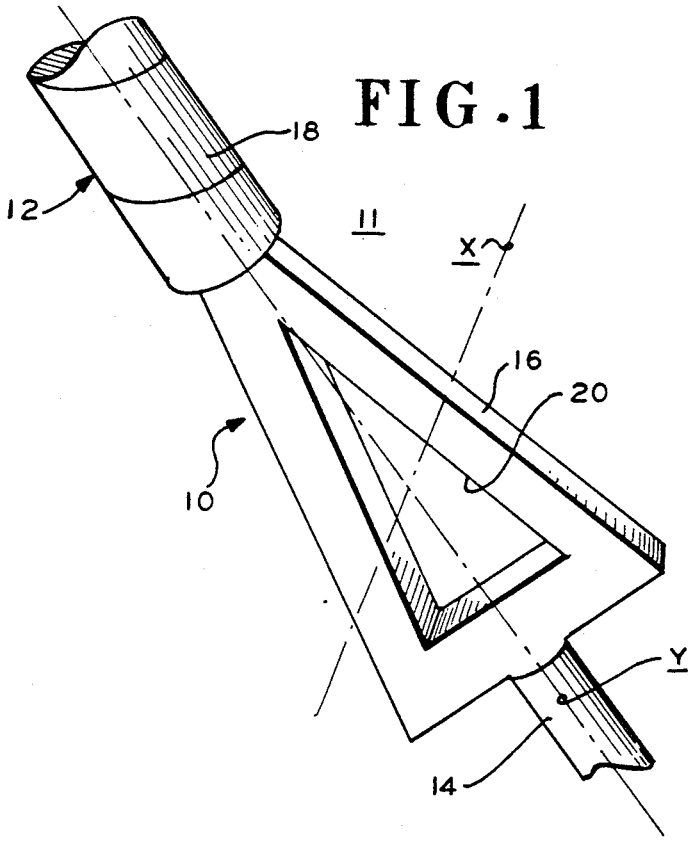
FIG. 1 is a perspective view of a portion of a golf club putter showing its handle and shaft and an intervening perceptor device according to the present invention.
Figure 2:
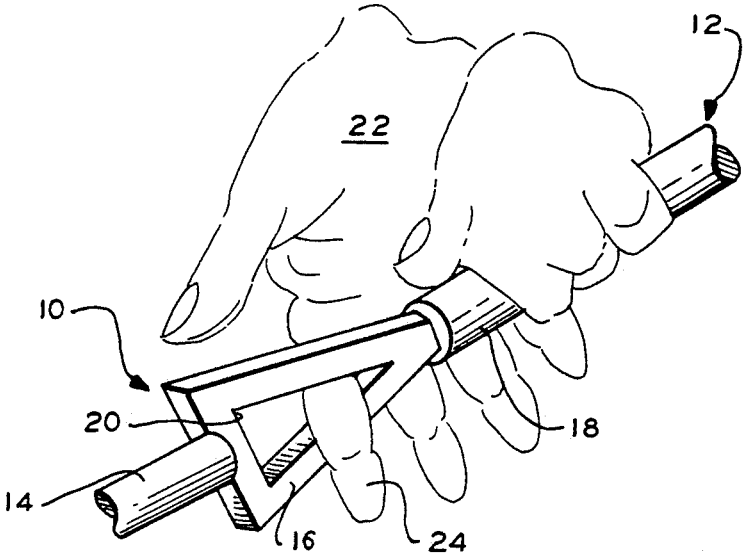
FIG. 2 is a perspective view of the putter of FIG. 1 detailing a golfer's hand grip and finger point in the use thereof.

Referring to the drawing wherein like numerals indicate like elements, there is shown in FIG. 1 and FIG. 2 the upper portion 10 of a golf club putter 11 which includes a preferred embodiment of the present invention. The golf club putter 11 includes a handle 12 and a shaft 14. In prior art golf clubs, one end of the shaft 14 mounts the handle or grip 12, while the other end mounts a putter head (not shown).

The golf club putter portion 10 of the present invention includes a perceptor device or finger-aligning member 16 interposed between the handle 12 and the shaft 14. The finger-aligning member 16 preferably has the triangular configuration depicted in FIGS. 1 and 2 and may be fabricated from a suitable metal or polymeric material. The finger-aligning member 16 may be integrally formed with the handle 12 and the shaft 14, or with either one of them, or it may be separately formed and later attached thereto in any suitable manner.

Figure 3:
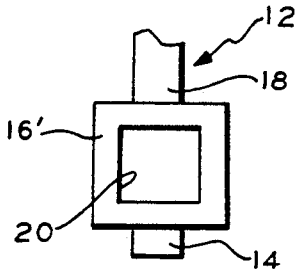
FIGS. 3–6 are alternative embodiments of the perceptor device shown in FIGS. 1 and 2.
Figure 4:
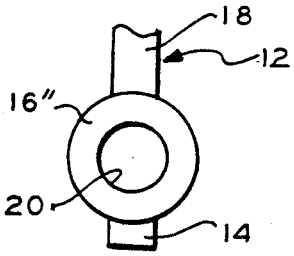
Figure 5:
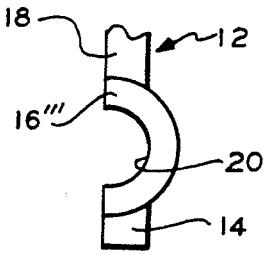
Figure 6:
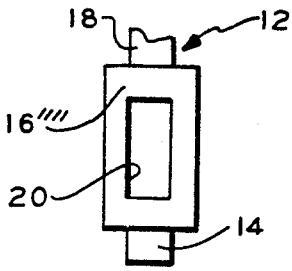

The finger-aligning member 16 defines a finger-receiving central opening 20 extending therethrough. The opening 16 "exposes" therewithin, and provides access to, the central, longitudinal axis X of the shaft 14 and the handle 12. The opening 20 preferably mirrors the geometric configuration of the finger-aligning member 16, and in the preferred embodiment of FIGS. 1 and 2, is triangular. An axis X of the opening 20 through the center or controid thereof intersects and is transverse to the central longitudinal axis Y of the shaft 14 and the handle 12.

Where the finger-aligning member 16 is square (FIG. 3), circular (16'' in FIG. 4), semi-circular (16'''' in FIG. 5) or rectangular (16'''' in FIG. 6), as contemplated by other embodiments hereof, the openings 20 may assume configurations which are complementary thereto.

Any of the finger-aligning member 16–16'''' may be formed separately from the handle 12 and/or the shaft 14 and may be marketed as such. The finger-aligning member 16–16'''' may, after purchase, be connected to the handle 12 and/or the shaft 14 by any number of common expedients, such as screw devices, welding, epoxy or other adhesives, by using common ferrule constructions. Also, the finger-aligning members 16–16'''' and the handle 12 may be cast, formed or otherwise manufactured as a unitary subassembly and marketed as such. The subassembly 12, 16 may be later attached to the shaft 14 by known expedients, including those mentioned above. A grip 18 may be attached to the handle 12 of the subassembly 12, 16.

The size of the central opening 20 is sufficiently large to permit a golfer's index finger 24 to assume a number of positional relationships relative thereto ranging from one where the pad of the finger 24 overlies the apex of the opening 20 and only slightly enters the opening 20 to one where the finger 24 pierces the plane of the opening 20 and extends substantially unhindered therethrough. These positional relationships all cause some portion of the finger 24 to rest at, on or in the "V" at the top of the opening 20.

The triangular finger-aligning opening 20 must accommodate a wide range of finger sizes, and to that end is preferably dimensioned to measure one and one-half inches at the base of the triangle (adjacent to the shaft 14) and three and one-quarter inches along each side of the triangle from the base to the apex adjacent the handle 12. With the triangular opening 20 assuming these dimensions, a reasonable range of finger sizes—from about 1½" diameter to about ⅝" diameter of smaller—may be accommodated.

When a golfer's hand 22 grips the handle 12 normally (FIG. 2), the central opening 20 is placed within easy reach of the index finger 24. The finger 24 may, accordingly, easily assume any of the positional relationships within the above-described range, and, as a consequence of being located within the uppermost, inverted "V" of the opening 20, the apex of which lies on the axis Y, aiming the portion of the finger 24 at or within the opening 20 at a target, such as a golf hole, rotates the shaft 14 about its axis Y to aim the axis X of the opening 20 in the direction of such target. The handle 12, the perceptor device 16, and the shaft 14 with the head (not shown) thereon are, of course, all fixedly interconnected. Thus, because the axes X and Y have a predetermined relationship to the head of the club 11, rotating the axis Y and aiming the axis X locates the head and ball-striking points in a predetermined spatial relationship relative to the target.

The triangular perceptor device 16 and its triangular opening 20 are thus preferred because they accommodate a wide range of finger sizes, permit a golfer's index finger 24 to assume a wide range of positional relationships with the opening 20—all of which relationships permit the finger 24 to be self-centered with respect to the opening 20 and, accordingly to be aligned with the axis Y—and provide the finger 24 with access to the axis Y so as to permit alignment of the axis X and the club head with a golf hole.

Any other shape for the opening 20, such as those shown in FIGS. 3–6, which achieve the foregoing desiderata may also be used.

Thus, the use of the present invention aids putting via the sense of touch, in lieu of the illusory "golfer's touch," which in reality relies upon only the sense of sight.

Use

As should be apparent from the above description, a function of the perceptor device 16 of the present invention is to expose the central longitudinal axis Y of the golf putter shaft 14. Because the opening 20 crosses the central longitudinal axis Y of the shaft 14, a golfer may place some portion of an index finger 24 at, on or through the opening 20 and, with the putter in ball-striking position, may point the portion of the finger 24 generally along the axis X of the opening 20 and towards a golf cup or hole while visually perceiving same. This is akin to the common ability to accurately point at an object with a finger while the object, but not the finger, is visible to the person doing the pointing. Accordingly, the finger-positioning member 16 and the opening 20 and its axis X are oriented with respect to an axis of the putter head such that, when the portion of the finger 24 which is at, on or within the opening 20 points toward the center of a golf cup, an axis of the putter head is normal to a line extending from a strike-point which lies the putter head axis to the center of the golf cup. By pointing the portion of the finger 24 which is at, on or within the opening 20 a golfer is provided with an exact and unhindered line of putt to the golf cup or hole.

Based upon the foregoing, it is apparent that the present invention provides an improved golf club putter which includes a finger-positioning perceptor device associated with the shaft, which perceptor serves as conduit for the combined use of the sense of touch and finger pointing to achieve accurate putting. The golfer's term "eye memory" is now replaced with the more sensitive and accurate "finger memory" provided by finger pointing via the device 16.

While the above description sets forth certain specific embodiments, these should not be construed as limitations on the scope of the invention, but rather as an exemplification of preferred embodiments thereof. Many variations are possible. For example, a double shaft appropriately constructed is one variation of the rectangular opening 20 of FIG. 6. The present invention may also be included with all types of golf clubs, not merely putters. Accordingly, the scope of the invention should be determined not by the embodiments illustrated, but by the appended claims.

I claim:

1. An improved golf club for striking a ball into a hole, the club being of the type having an elongated shaft, a handle at one end of the shaft, and a head mounted at the other end of the shaft, wherein the improvement comprises:

a generally planar member located between the handle and the one end of the shaft, the member having a finger-alligning opening therethrough, the central, longitudinal axis of the shaft passing through the opening, the opening being triangular and having an apex intersecting the central, longitudinal axis of the shaft so that locating the finger portions on, at or through the opening centers the finger portion relative to the apex and relative to the axis; the opening and the handle being relatively positioned so that when the handle is manually gripped preparatory to using the club, a portion of an index finger is locatable on, at or through the opening so that the finger is pointable through the axis of the shaft at the center of the hole; the axis of the shaft and an axis and an included ball-striking point of the head being interrelated so that such pointing of the finger at the center of a golf hole while the ball is addressed orients the axis of the head normally to a line extending between the ball-striking point and the center of the hole.

2. An improved golf club as in claim 1, wherein:

the opening is sufficiently large to accommodate the insertion thereinto or therethrough of a substantial portion of the finger so that the inserted finger extends generally along an axis of the opening which is perpendicular to the axis of the shaft and to the axis of the head.

3. An improved golf club as in claim 1, wherein:

the legs of the triangle defining the apex engage the finger portion to center it relative to the apex and align it relative to the axis of the shaft.

4. An improved golf club as in claim 1, wherein the member and the opening are triangular with a base of each being adjacent to the shaft and an opposite apex of each being adjacent to the handle.

5. An improved golf club as in claim 4, wherein:

the apex intersects the central, longitudinal axis of the shaft so that locating the finger portion on, at or through the opening centers the finger portion relative to the apex and relative to the axis.

6. An improved golf club as in claim 5, wherein:

the opening is sufficiently large to accommodate the insertion thereinto or therethrough of a substantial portion of the finger so that the inserted finger extends generally along an axis of the opening which is perpendicular to the axis of the shaft and to the axis of the head.

7. An improved golf club as in claim 6, wherein:

the legs of the triangle defining the apex engage the finger portion to center it relative to the apex and align it relative to the axis of the shaft.

8. A perceptor device for enhancing the ability to strike a ball into a golf hole with a golf club; the golf club being of the type which has an elongated shaft, a handle and a head, with the head having an included axis on which lies a ball-striking point; the device comprising:

(a) a generally planar member, the member having a finger-aligning opening therethrough, the opening being triangular and having an apex intersecting the central, longitudinal axis of the shaft so that locating the finger portion on, at or through the opening centers the finger portion relative to the apex and relative to the axis; and (b) means for mounting the member between the handle and the shaft so that (i) the opening and the handle are relatively positioned to permit a portion of an index finger to be located on, at or through the opening when the handle is manually gripped preparatory to using the club;

(ii) the opening, the axis of the shaft and the axis and ball-striking point of the head are interrelated to position the axis of the head in an orientation which is normal to a line extending between the ball-striking point and the center of the hole when the finger is pointed at the center of the golf hole while the ball is being addressed.

9. A perceptor device as in claim 8, wherein:

the opening is sufficiently large to accommodate the insertion thereinto or therethrough of a substantial portion of the finger so that the inserted finger extends generally along an axis of the opening which is perpendicular to the axis of the shaft and to the axis of the head.

10. A perceptor device as in claim 8, wherein:

the legs of the triangle defining the apex engage the finger portion to center it relative to the apex and align it

11. A perceptor device as in claim 8, wherein the member and the opening are triangular with a base of each being adjacent to the shaft and an opposite apex of each being adjacent to the handle.

12. A perceptor device as in claim 11, wherein:

the apex intersects the central, longitudinal axis of the shaft so that locating the finger portion on, at or through the opening centers the finger portion relative to the apex and relative to the axis.

13. A perceptor device as in claim 12, wherein:

the opening is sufficiently large to accommodate the insertion thereinto or therethrough of a substantial portion of the finger so that the inserted finger extends generally along an axis of the opening which is perpendicular to the axis of the shaft and to the axis of the head.

14. A perceptor device as in claim 13, wherein:

the legs of the triangle defining the apex engage the finger portion to center it relative to the apex and align it relative to the axis of the shaft.

* * * * *